US006511218B2

(12) United States Patent
Keough

(10) Patent No.: US 6,511,218 B2
(45) Date of Patent: Jan. 28, 2003

(54) COVER ASSEMBLY FOR A PAINT CAN

(75) Inventor: James A. Keough, Howell, MI (US)

(73) Assignee: Dedoes Industries, Inc., Walled Lake, MI (US)

( * ) Notice: Subject to any disclaimer, the term of this patent is extended or adjusted under 35 U.S.C. 154(b) by 55 days.

(21) Appl. No.: 09/827,002

(22) Filed: Apr. 5, 2001

(65) Prior Publication Data

US 2002/0145939 A1 Oct. 10, 2002

(51) Int. Cl.[7] ..... B01F 7/20; B01F 15/00
(52) U.S. Cl. ..... 366/247; 366/347; 366/605
(58) Field of Search ..... 366/247, 244, 366/245, 347, 605; 220/238, 315, 700

(56) References Cited

U.S. PATENT DOCUMENTS 1,383,336 A * 7/1921 Phillips
2,281,649 A * 5/1942 Williams
2,720,329 A * 10/1955 Kochner
3,041,052 A * 6/1962 Dedoes
3,162,338 A * 12/1964 Grubelic
3,704,007 A * 11/1972 Kroeger ..... 366/248
5,199,788 A * 4/1993 Stallings ..... 366/247
5,437,385 A * 8/1995 Fillon ..... 220/238
5,533,802 A * 7/1996 Garganese ..... 366/605
5,603,426 A * 2/1997 Krzywdziak et al. ..... 220/315
5,676,463 A * 10/1997 Larsen ..... 366/605

* cited by examiner

*Primary Examiner*—Tony G. Soohoo
(74) *Attorney, Agent, or Firm*—Gifford, Krass, Groh, Sprinkle, Anderson & Citkowski, P.C.

(57) ABSTRACT

A cover assembly is disclosed for a paint can for use with automatic stirring equipment. The paint can includes a tubular cylindrical sidewall and an open top. The cover assembly has a lid dimensioned to overlie the open top of the paint can, and a spout is formed on the lid. A paint stirrer is rotatably mounted to the lid and at least one locking foot removably secures the lid to the paint can when the lid overlies the open top of the paint can. The lid includes a plurality of resilient tabs which engage the outer periphery of the paint can around the top of the paint can to center the lid relative to the paint can.

9 Claims, 2 Drawing Sheets

COVER ASSEMBLY FOR A PAINT CAN

BACKGROUND OF THE INVENTION

I. Field of the Invention

The present invention relates generally to a cover assembly for a paint can for use with automatic mixing equipment.

II. Description of Related Art

There are a number of previously known cover assemblies which are designed to overlie the open top of a paint can. Such cover assemblies typically include a spout and a cooperating closure which selectively opens and closes the spout. When the spout is open, paint can be poured from the can.

Many of these previously known cover assemblies are designed for use with automatic stirring equipment. As such, they include a stirring assembly rotatably mounted to the cover assembly so that a stirrer is positioned within the interior of the can. A driven member extends upwardly from the paint can and cooperates with a drive member in a rack of the automatic paint stirring equipment in order to continually stir the paint whenever the can is placed in the rack. Such automatic paint stirring equipment is typically used in automotive body repair shops and the like.

Paint cans are typically tubular and cylindrical in shape thus having a tubular and cylindrical sidewall which is open at its top. Such paint cans, furthermore, are conventionally manufactured in two basic sizes, namely a quart or liter paint can, and a gallon or imperial gallon paint can.

Unfortunately, there is little standardization in the paint industry as to the dimensions of the paint can for a quart size or liter size of paint. The same is also true for gallon paint cans. Consequently, the outside diameter for a paint can varies not only between a quart and liter size of paint can, but also between quart or liter sizes from different manufacturers. The same is also true for gallon size paint cans.

For cover assemblies of the type used in automatic paint stirring equipment, it is important that the paint cover be centered with respect to the paint can. Otherwise, an undesirable torque may be imparted by the stirring assembly by the paint stirring equipment. Indeed, if the cover assembly is misaligned with respect to the paint can, the stirring assembly may disadvantageously contact the interior of the paint can as it is rotatably driven.

SUMMARY OF THE PRESENT INVENTION

In brief, the present invention provides a cover assembly for use with automatic paint stirring equipment which overcomes all of the above-mentioned disadvantages of the previously known devices.

In brief, the cover assembly of the present invention comprises a generally circular lid which is dimensioned to overlie the open top of the paint can. Paint stirring means are rotatably mounted to the lid and at least one locking device removably secures the lid to the paint can when the lid is positioned over the open top of the paint can.

The paint can lid further includes an annular skirt around its outer periphery. This annular skirt has a diameter greater than the sidewall of the paint can so that, with the lid overlying the open top of the paint can, the skirt is spaced radially outwardly from the paint can sidewall adjacent the open top of the paint can.

The annular skirt includes a plurality of circumferentially spaced resilient tabs. Each tab includes a free end which protrudes radially inwardly so that the free end of each tab engages the outer periphery of the paint can around the open top of the paint can. In doing so, the resilient tabs serve to center the lid with respect to the paint can. Furthermore, the annular skirt as well as the resilient tabs are dimensioned to accommodate a particular size of paint can, for example a quart or liter paint can, despite small differences in the diameter of the paint can.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
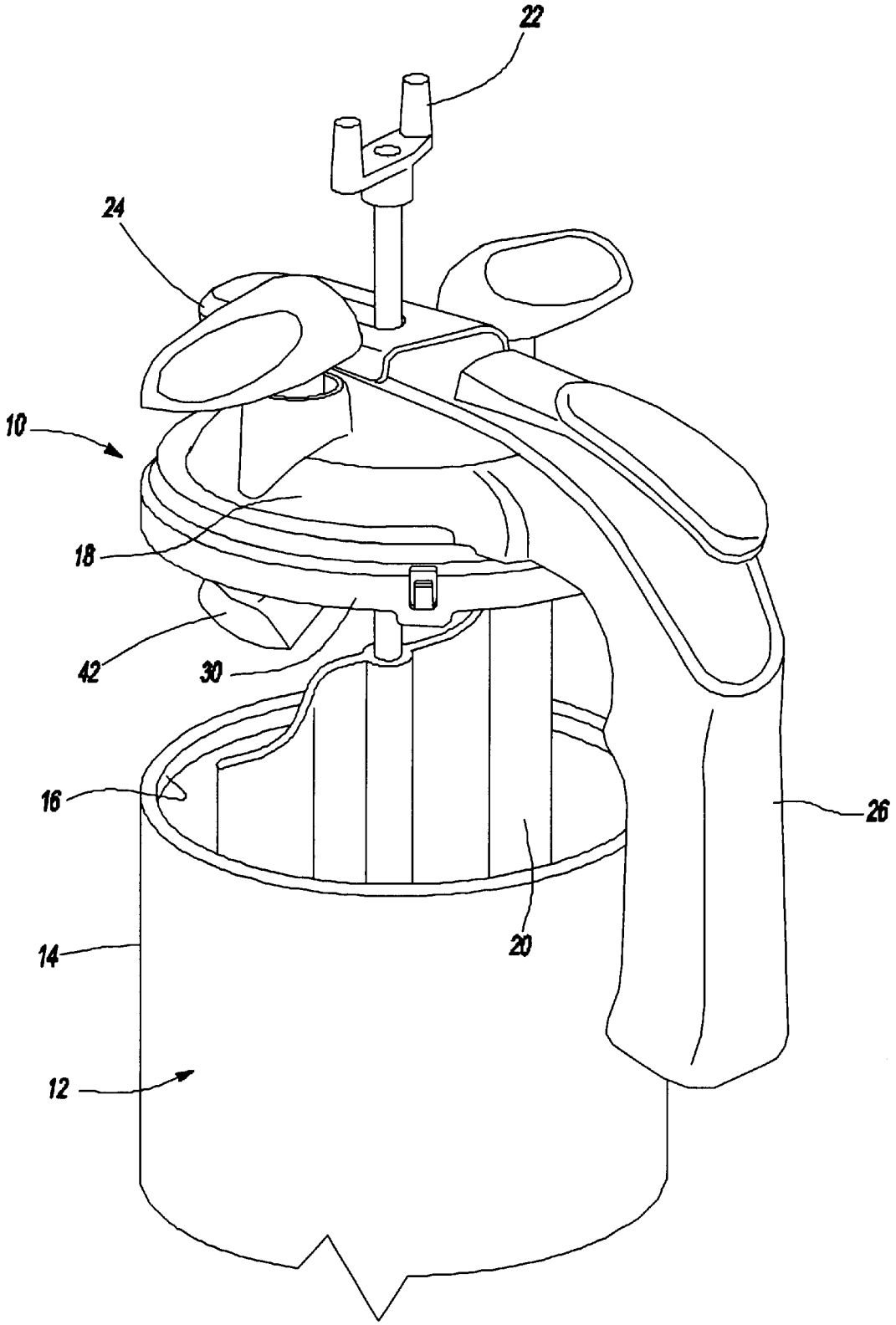
FIG. 1 is an elevational view illustrating a preferred embodiment of the invention.

With reference first to FIG. 1, a preferred embodiment of the cover assembly 10 of the present invention is there shown for use with a paint can 12. The paint can 12 includes a tubular cylindrical sidewall 14 and is open at its top 16.

The cover assembly 10 further comprises a lid 18 which is generally circular in shape and is dimensioned to overlie the open top 16 of the paint can 12. The cover assembly 10, furthermore, is intended for use with automatic paint stirring equipment and, as such, includes a paint stirrer 20 rotatably mounted to the lid 18. Consequently, with the lid 18 positioned over the open top 16 of the paint can 12, the paint stirrer 20 is positioned within the interior of the paint can 12. Similarly, a driven member 22 protrudes upwardly from the top of the lid 18 which is engaged by a drive means in the automatic paint stirring equipment (not shown).

Figure 2:
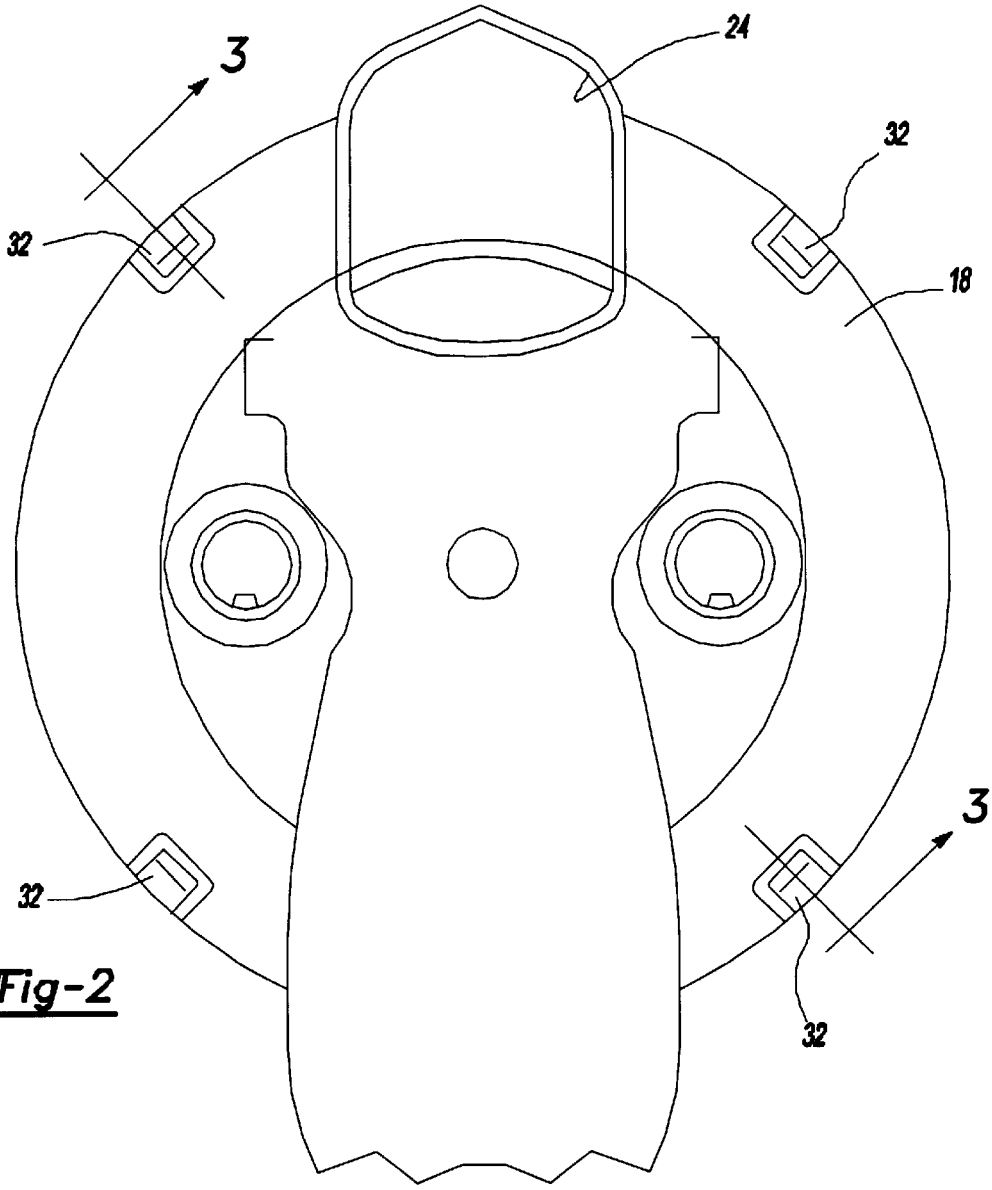
FIG. 2 is a top view of the preferred embodiment of the invention.

Referring now to FIGS. 1 and 2, in the conventional fashion, the cover assembly 10 includes a spout 24 from which paint from the can 12 can be dispensed. A handle 26 (FIG. 2) extends outwardly from the lid 18 and is generally diametrically opposed from the spout 24.

Figure 3:
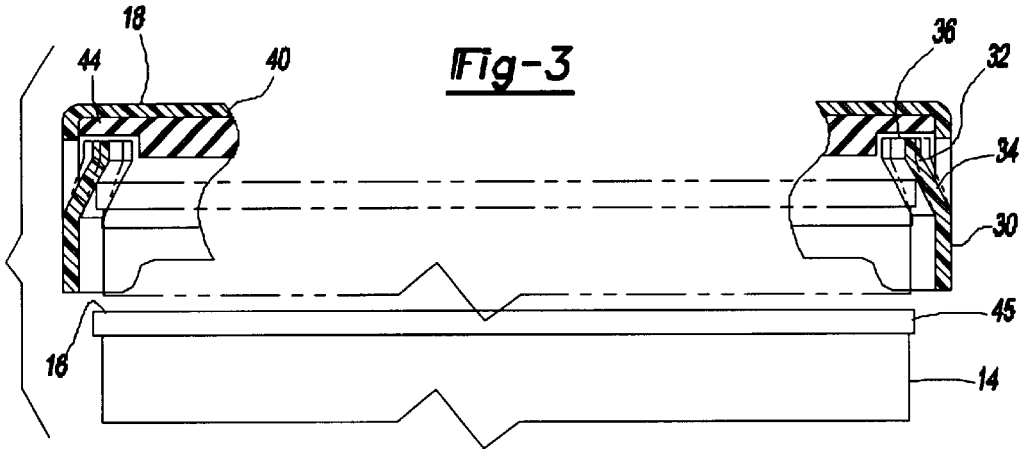
FIG. 3 is a view taken along line 3—3 in FIG. 2.

With reference to FIGS. 1–3, unlike the previously known cover assemblies for paint cans used with automatic stirring equipment, an annular skirt 30 is formed around the outer periphery of the lid 18. Thus, with the lid 18 positioned over the open top 16 of the paint can 12, the skirt 30 encompasses a portion of the outer periphery of the paint can 12 adjacent its top 16 as best shown in FIG. 3. Furthermore, the skirt 30 has an inside diameter greater than the outside diameter of the paint can sidewall 14 for a given size paint can, e.g. a quart size paint can, so that the annular skirt 30 is spaced radially outwardly from the outer periphery of the paint can sidewall 14.

With reference now to FIGS. 2 and 3, at least one, and preferably four, resilient tabs 32 are formed from the annular skirt 30 so that the tabs 32 are circumferentially spaced around the skirt 30. Preferably, the tabs 32 are equidistantly circumferentially spaced around the skirt 30 so that two tabs 32 are diametrically opposed from each other and, likewise, the other two resilient tabs 32 are also diametrically opposed from each other.

With reference particularly to FIG. 3, each tab 32 includes a first end 34 which is secured to the skirt 30 and a free end 36 which protrudes radially inwardly towards its diametrically opposed tab. Consequently, the free ends 36 of the resilient tabs 32 are able to flex in a radial direction with respect to the paint can lid 18 as best shown in phantom line.

The resilient tabs 34 are dimensioned so that, in their free or unflexed state, the free ends 36 of the tabs 32 engage the outer periphery of the paint can 12 as the lid 18 is positioned over the open top 16 of the paint can 12 regardless of minor variations of the diameter of the paint can 12. As such the inside diameter of the skirt 30 is larger than the largest expected diameter of the paint can 14 for a given size of the paint can. Consequently, when the lid 18 is positioned over the top 16 of the paint can 12, the free ends 36 of the resilient tabs 32 engage the outer periphery of the paint can 12 and serve to center the lid 18 with respect to the paint can 12. In doing so, the stirrer 20 is automatically centered with respect to the paint can 12.

Still referring to FIG. 3, an annular seal 40 is mounted to the paint can lid 18 so that the seal 40 is sandwiched in between the lid 18 and the top 16 of the paint can 12. The paint can lid 18 is then removably secured to the paint can 12 by any conventional means, such as locking feet 42 (FIG. 1), which compresses the seal 40 between the lid 18 and the top of the paint can 12 to fluidly seal the lid 18 to the paint can 12.

Preferably, the seal 40 includes an outer reduced thickness portion 44 which is aligned with the free ends 36 of the resilient tabs 32. This construction thus ensures that the free ends 36 of the locking tabs 32 do not jam under the outwardly protruding lip 45 common on most paint cans.

In the preferred embodiment of the invention, the lid 18, flange 30, tabs 32 and handle 18 are all of a one-piece plastic construction.

Having described my invention, it can be seen that the present invention provides an improved paint can lid for use with automatic paint stirring equipment. Having described my invention, however, many modifications thereto will become apparent to those skilled in the art to which it pertains without deviation from the spirit of the invention as defined by the scope of the appended claims.

I claim:

1. A cover assembly for a paint can for use with automatic stirring equipment, the paint can having a tubular cylindrical sidewall and an open top, said cover assembly comprising:

a lid dimensioned to overlie the open top of the paint can, said lid having a spout, paint stirring means rotatably secured to said lid, at least one locking device which removably secures said lid to the paint can when said lid overlies the open top of the paint can, said lid having an annular skirt having a diameter greater than the can sidewall so that with said lid overlying the open top of the paint can, said skirt is spaced radially outwardly from the can sidewall adjacent the open top of the paint can, said lid including a plurality of circumferentially spaced and diametrically opposed resilient tabs formed on said skirt, each of said tabs being diametrically flexible relative to its associated diametrically opposed tab and diametrically movable relative to said skirt, wherein said tabs engage the paint can and centers said lid and said skirt relative to the can sidewall.

2. The invention as defined in claim 1 wherein said lid, said skirt and said tabs are of a one-piece construction.

3. The invention as defined in claim 1 wherein said tabs are dimensioned to frictionally engage an outer periphery of the can sidewall.

4. The invention as defined in claim 1 and comprising an annular resilient seal secured to a lower surface of said lid, said seal dimensioned to abut against the top of the paint can.

5. The invention as defined in claim 4 wherein said seal includes an annular outer reduced thickness portion, and wherein said tabs have an end aligned with said reduced thickness portion.

6. The invention as defined in claim 1 wherein each tab has a top, bottom and two sides and wherein said tab bottom is attached to said lid while said tab top and said tab sides are moveable relative to said lid.

7. A cover assembly for a paint can for use with automatic stirring equipment, the paint can having a tubular cylindrical sidewall and an open top, said cover assembly comprising:

a lid dimensioned to overlie the open top of the paint can, said lid having a spout, paint stirring means rotatably secured to said lid, at least one locking device which removably secures said lid to the paint can when said lid overlies the open top of the paint can, said lid including at least one resilient tab which engages the paint can and centers said lid relative to the can sidewall, wherein said lid further comprises an annular skirt having a diameter greater than the can sidewall so that with said lid overlying the open top of the paint can, said skirt is spaced radially outwardly from the can sidewall adjacent the open top of the paint can, and wherein said at least one resilient tab is mounted on said skirt, wherein said at least one resilient tab comprises a plurality of resilient tabs circumferentially spaced from each other around said skirt, and an annular resilient seal secured to a lower surface of said lid, said seal dimensioned to abut against the top of the paint can.

8. The invention as defined in claim 7, wherein said lid, said skirt and said tabs are of a one-piece construction.

9. The invention as defined in claim 7 wherein said seal includes an annular outer reduced thickness portion, and wherein said tabs have an end aligned with said reduced thickness portion.

* * * * *